United States Patent [19]

George

[11] Patent Number: 4,928,430

[45] Date of Patent: May 29, 1990

[54] PIVOTABLE BUMPER GUARD

[76] Inventor: Harry George, 8 S. 511 Bell Dr., Naperville, Ill. 60565

[21] Appl. No.: 333,126

[22] Filed: Apr. 4, 1989

[51] Int. Cl.[5] ..... E06B 3/30

[52] U.S. Cl. ..... 49/460; 49/70

[58] Field of Search ..... 49/460, 462, 70, 383, 49/141

[56] References Cited

U.S. PATENT DOCUMENTS

| | | | |
|---|---|---|---|
| 2,867,858 | 1/1959 | Wiesner | 49/383 |
| 2,899,718 | 8/1959 | Engels | 49/460 |
| 3,001,814 | 9/1961 | Skalko | 49/460 |
| 3,091,818 | 6/1963 | Clark | 49/460 X |
| 4,344,253 | 8/1982 | Stiles | 49/462 X |

*Primary Examiner*—Philip C. Kannan

*Attorney, Agent, or Firm*—Lee, Mann, Smith, McWilliams & Sweeney

[57] ABSTRACT

A pivotable guard for use with automatically opening doors such as those commonly found at grocery stores. The bumper guard is placed near the outside of the pivoting door stile of the ingress door to deflect carts from coming into contact with the pivoting door stile, thereby preventing damage to the door. The bumper guard is attached to a supporting post and is pivotable from a normal position, wherein it deflects carts from the pivoting door, to a retracted position, wherein the ingress door may be opened outwardly at least 90° from its closed position to allow emergency egress from the store.

14 Claims, 2 Drawing Sheets

PIVOTABLE BUMPER GUARD

BACKGROUND OF THE INVENTION

In general, aluminum framed doors are used at the entrance and exits of commercial retail stores such as grocery stores. A large number of these aluminum frame doors are installed by means of center pivots due to state and local codes which require that emergency egress from a building be accomplished whereby the ingress door must also swing outward for egress from the building. On manually operated doors, this can be accomplished with the use of double-acting door operator closers, whereby the door will swing in as well as out.

On power activated doors (i.e., automatic swinging doors), the direction of swing is controlled automatically in a single (one way) direction of travel. In accord with the Life Safety Code regulations, and with the American National Standards Institute (ANSI) standards for power-operated doors, there are specific requirements for egress and emergency egress from a commercial establishment. To meet the criteria prescribed in the codes, the majority of automatic doors (as well as manually-operated doors) must be capable of swinging in both directions. An automatic door must be capable of being pivoted to its panic breakout or emergency egress position with a manual force of not to exceed 50 pounds applied one inch from the edge of the lock style jamb (Ref: ANSI A156.10-1979-11.4). Therefore, an automatic "in" door is operated by automatic means to open into the store, and a panic breakout feature is provided so the door will open manually in the opposite direction to allow egress out of the store through the "in" door.

A major concern to the owners of stores with aluminum frame doors is the constant abuse to the doors in the top and bottom pivots from the impact of shopping carts to these doors. This abuse necessitates significant expense for repairs as well as safety hazards for their customers. When a door is broken and does not operate properly, customer injury can occur because the person entering the store expects the door to open, but instead of opening without resistance, the door is bound or broken, or the door falls to the floor on touch.

Numerous kinds and types of protection for high-traffic aluminum frame doors are now in use. One such type of protection is the use of guard rails. Guide or guard rails are required on the swing side of automatic doors, but guard rails are frequently used on the approach side of doors as a means to protect (to some degree) the doors and door jambs from abuse by shopping carts. The design and placement of guard rails is most critical to allow panic breakaway of the door to 90° from the closed position of the door. When a guard rail is installed to meet the 90° criteria for emergency or panic breakaway, these guard rails provide minimal protection, and in most instances, no protection from direct impact of shopping carts to the doors.

Another type of protection used are cart bars or grill guards. These are commonly attached directly to the approach side of high-traffic aluminum frame doors as a means of door protection. Placement of these types of door protectors are made for the dual purpose of preventing shopping carts from coming in contact with the glass in the doors as well as being an impact device to engage the shopping cart and limit the abuse to the door. Although minimal protection is obtained for the actual door surface, the constant impact of shopping carts against the cart bars or grill guards does jar the door, and causes stress and abuse to the top and bottom pivot as well as to the door itself. In combination with the use of guard rails, the effectiveness of both the guard rail and the cart barrier is greatly diminished.

SUMMARY OF THE INVENTION

The bumper guard of the present invention is used with doors of the type and kind typically used in grocery stores and other retail establishments that provide shopping carts for their customers' use. The present bumper guard provides adequate protection to both the door and the top and bottom door pivots by preventing shopping carts from impacting the door on the normal approach side of the door, thereby reducing the service and maintenance problems caused by shopping carts. More specifically, the bumper guard prevents shopping carts from coming into contact with the center pivot stile of a door by directing shopping carts away from the face of the door by means of the initial impact of the shopping cart against the bumper guard. The bumper guard provides adequate means of door and pivot protection as described above, with the capability of being retracted by engagement of the door against a spacing means such as a projecting wheel on the bumper guard, and thus pivoting the bumper guard away from the door and providing a 90° panic breakaway position of the door. When the door is repositioned to its normal operating closed position, or 0°, the bumper guard will resiliently return in an automatic fashion to its normal position to provide protection to the door and pivots. The bumper guard is an integral design, preferably made of finished, fabricated stainless steel that can be mounted in various ways to provide protection for doors, door jambs, columns, corners, etc. The bumper guard is comprised generally of a bumper and a post. The post in positioned adjacent to the exterior face of the door pivot jamb. The upper end of the post is affixed to a stationary body such as a door pivot jamb and the lower end of the post is affixed to a stationary body such as a floor by a baseplate. The bumper is pivotably attached to the post a short distance above the floor by a spring hinge. The bumper has a flat portion on the side near the door which extends parallel to the door from the post a distance past the pivoting door stile. On the other side of the bumper is a curvilinear portion which deflects the carts away from the door. A wheel extends from the flat portion of the bumper to rollingly engage the door as the door is pivoted between its closed and emergency breakout positions. The spring hinge allows the bumper to pivot between its normal position wherein it will deflect carts and its retracted position wherein it will allow the door to rotate at least 90° from its closed position to its emergency breakout position. As the door is returned to its closed position from its emergency breakout position, the spring hinge will automatically pivot the bumper from its retracted position back to its normal position.

BRIEF DESCRIPTION OF THE DRAWINGS

The invention is described in greater detail in the following detailed description of an example embodying the best mode of the invention, taken in conjunction with the drawings, in which.

DESCRIPTION OF AN EXAMPLE EMBODYING THE BEST MODE OF THE INVENTION

Figure 2:
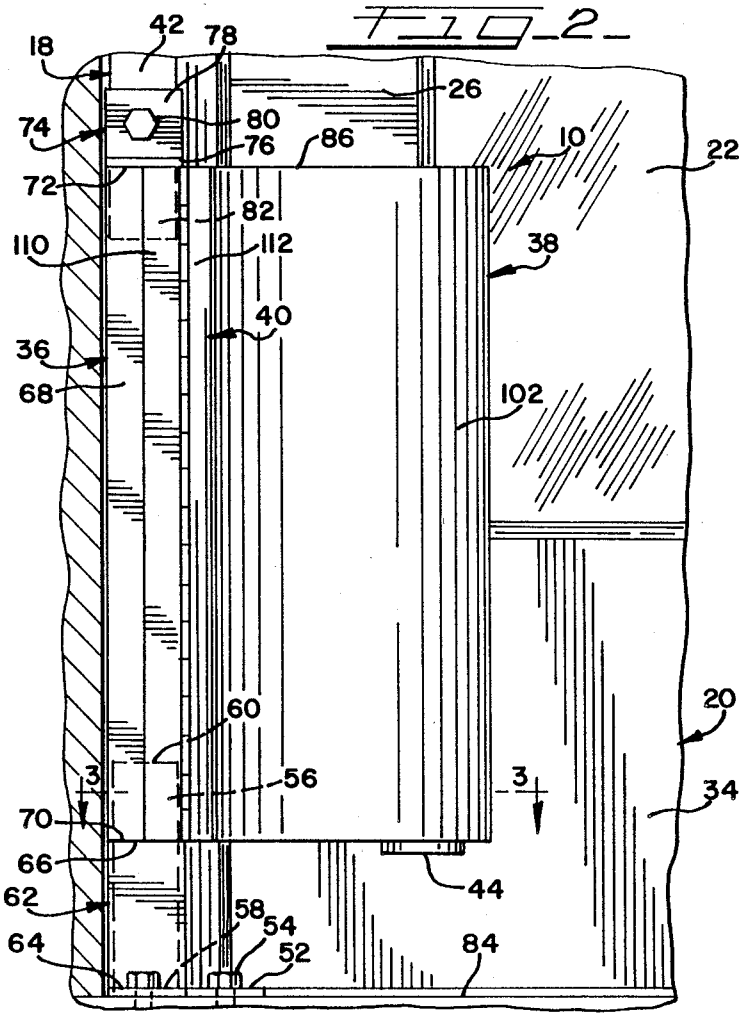
FIG. 2 is a front elevational view of the pivotable bumper guard.
Figure 1:
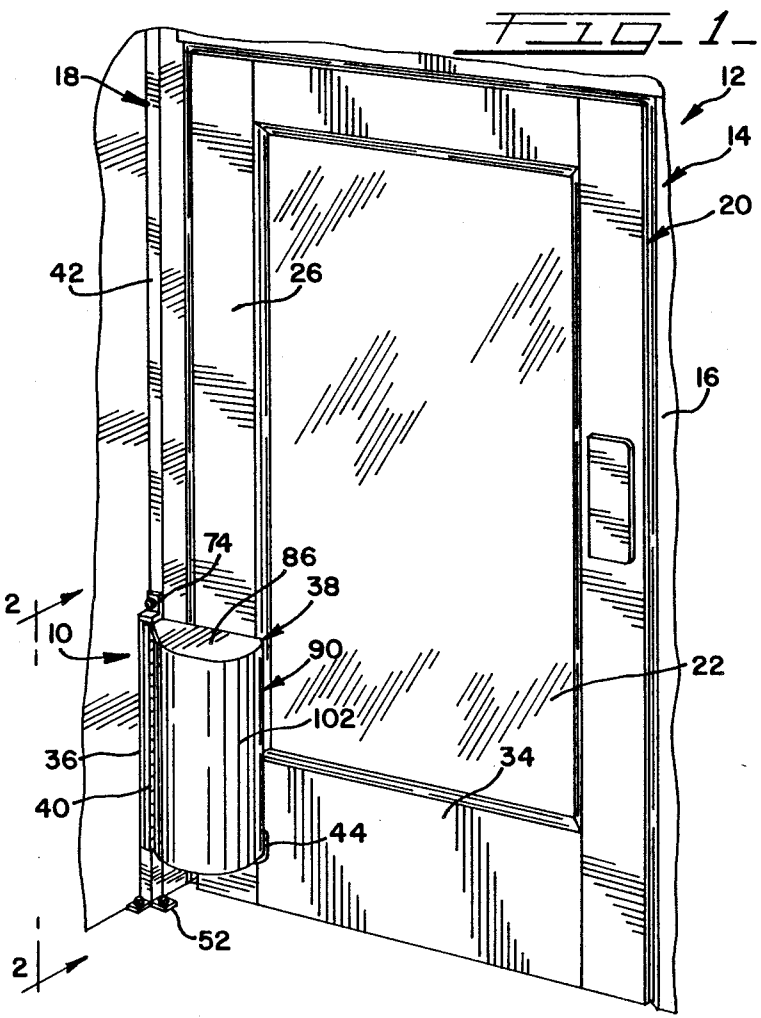
FIG. 1 is a perspective view of an automatic door mechanism with the pivotable bumper guard of the present invention.
Figure 3:
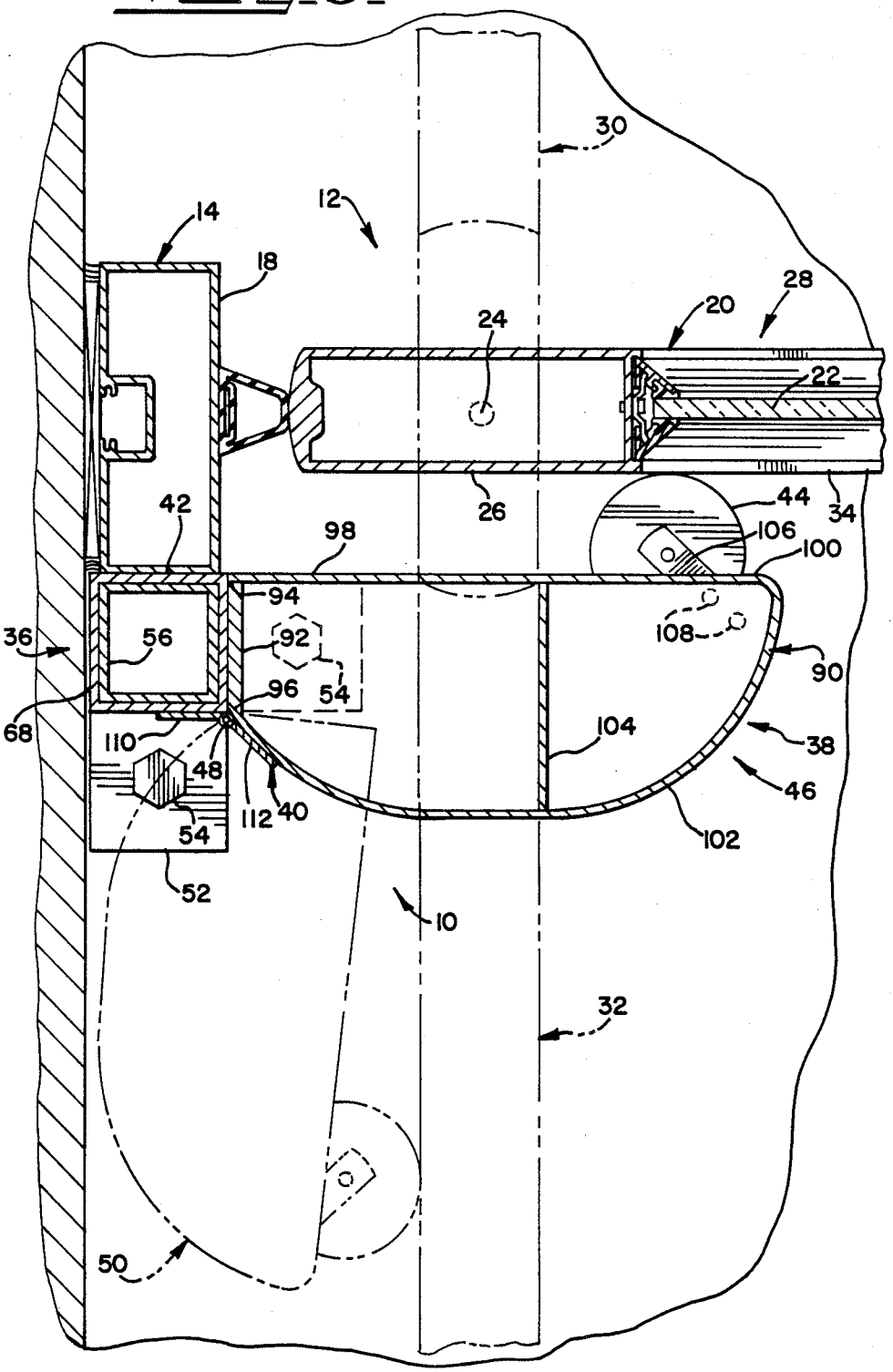
FIG. 3 is a cross-sectional view of the pivotable bumper guard taken along lines 3—3 of FIG. 2.

A bumper guard 10 is provided for use with an automatic door mechanism 12. The automatic door mechanism 12 has a door frame 14 having a door lock jamb 16 and a door pivot jamb 18. A door 20 having a glass pane 22 is located within the door 20. The door 20 is pivotably connected to the door frame 14 at the pivoting door stile 26 of door 20 and pivots about the door pivot axis 24. In normal operation, the door 20 pivots inward from its closed position 28 to its open position 30 to allow ingress through the automatic door mechanism 12. The door 20 is also capable of pivoting outward from its closed position 28 to an emergency breakout position 32, which is disposed at least 90° from the closed position 28 to allow emergency egress through the automatic door mechanism 12.

The bumper guard 10 is positioned on the exterior side 34 of door 20. The bumper guard 10 has a stationary vertical post 36, to which the bumper 38 is pivotably attached by a spring hinge 40. The post 36 is positioned adjacent to the exterior face 42 of the door pivot jamb 18. The bumper 38 extends from the post 36 parallel to the door 20 a sufficient distance to extend past the pivoting door stile 26. A spacing means such as a wheel 44 is attached to the bumper and is positioned in close proximity to the exterior side 34 of the door 20 to engage the exterior side 34 of the door 20 as it moves from its closed position 28 to its emergency breakout position 32 without damaging the exterior side 34 of door 20.

The post 36 has a generally L-shaped base plate 52 located at the post's bottom end which is fastened to a stationary body such as the floor 84 with fasteners 54. A square interior tube 56 has a first end 58 affixed to the base plate 52 and extends vertically upward therefrom to a second open end 60. A square spacer tube 62 is placed in close proximity concentrically around the interior tube 56 to provide clearance between the wheel 44 and the floor 84. The square spacer tube 62 has a first end 64 abutting against base plate 52 and a second end 66 positioned below the second open end 60 of the interior tube 56. A square support tube 68, for the attachment and support of the bumper 38, is placed in close proximity concentrically around the interior tube 56. The support tube 68 has a first end 70 abutting against the second end 66 of the spacer tube 62, and extends vertically upwards therefrom to a second open end 72 which is vertically above the second open end 60 of the interior tube 56. A top cap 74 engages the second open end 72 of the support tube 68 and is fastened to a stationary body such as the exterior face 42 of the door pivot jamb 18.

The top cap 74 comprises a first plate 76 which is horizontal and is in abutting contact with the second open end 72 of the support tube 68. A second plate 78 extends vertically upwards from one edge of the first plate 76 for fastening the top cap 74 and the support tube 68 which it engages to the exterior face 42 of the door pivot jamb 18 with fastener 80. A square cap tube 82 extends downwardly from the underside of the first plate 76 and is located in close proximity concentrically within the second open end 72 of the support tube 68. The post 36 is positioned adjacent to the exterior face 42 of the door pivot jamb 18. The base plate 52 is fastened to the floor 84 with fasteners 54. The second plate 78 of the top cap 74 is placed adjacent to the exterior face 42 of the door pivot jamb 18 and is fastened thereto with fastener 80.

The bumper 38 has a top portion 86 and a bottom portion 88 which are parallel to one another. A side wall 90 extends between and around the edges of the top portion 86 and the bottom portion 88. The distance between the top of the top portion 86 and the bottom of the bottom portion 88 is equal to the length of the support tube 68. The sidewall 90 comprises an abutting plate portion 92 which abuts the support tube 68 to prevent the bumper 38 from pivoting from its normal position 46 towards the door 20. The abutting plate portion 92 has a square side 94 and a beveled side 96. A planar sidewall portion 98 extends perpendicular to the abutting plate portion 92 from the square side 94 to the edge 100 of the bumper 38 and is parallel to the plane of the door 20 when said bumper 38 is in its normal position 46, thereby allowing the bumper 38 to be positioned closely adjacent to said door 20. A curvilinear sidewall portion 102 extends from the edge 100 in a generally semicircular manner to the beveled side 96 of the abutting plate portion 92 to deflect moving objects away from the door 20. The abutting plate portion 92 is thicker than the planar sidewall portion 98 and the curvilinear sidewall portion 102, which are both the same thickness. A brace plate 104 is affixed between the planar sidewall portion 98, the curvilinear sidewall portion 102, the top portion 86 and the bottom portion 88 to strengthen the bumper 38. A wheel 44 is rotatably affixed to the bottom portion 88 by bracket 106 through apertures 108. The wheel 44 extends from the planar sidewall portion 98 of the bumper 38, and is in close proximity with the exterior side 34 of door 20 to rollingly engage the door 20 when it is moved towards its emergency breakout position 32.

A resilient spring hinge 40, having a first leg 110 and a second leg 112, with both legs extending from and pivotable about a common bumper pivot axis 48, is pivotably joined between the post 36 and the bumper 38 to pivotally support the bumper 38 above the floor 84. The first leg 110 is affixed to the support tube 68 and the second leg 112 is affixed to the curvilinear sidewall portion 102 near the abutting plate portion 92, with the spring hinge 40 extending the length of the curvilinear sidewall portion 102, to allow the bumper 38 to pivot between its normal position 46 and its retracted position 50 about the bumper pivot axis 48. The spacer tube 62 provides clearance between the floor 84 and the wheel 44 so that the bumper 38 may freely pivot about the bumper pivot axis 48.

In its normal position 46, the bumper 38 cannot be pivoted towards the door 20 and can deflect moving objects away from the pivoting door stile 26 and away from the exterior side 34 of the door 20. When the door 20 is pivoted to its emergency breakout position 32, the exterior side 34 of the door 20 comes into rolling engagement with wheel 44. As the wheel 44 rolls along the exterior side 34 of the door 20, the bumper 38 is pivoted about the bumper pivot axis 48 of the spring hinge 40 to a retracted position 50 wherein the door 20 is in its emergency breakout position 32. When the door 20 is returned to its closed position 28, the spring hinge 40 will resiliently pivot the bumper 38 back to its normal position 46.

What is claimed is:

1. A bumper guard pivotable between a normal and a retracted position for use with a door which pivots inward and outward from a closed position about a pivoting door stile, comprising:

a stationary support:

a bumper, said bumper being in abutting contact with said stationary support and being located adjacent to said pivoting door stile when in its normal position; and pivot means pivotally joining said bumper to said stationary support, said pivot means allowing said bumper to pivot between its normal and its retracted positions, wherein said bumper, when in the retracted position, will allow said door to pivot towards said bumper to a position which is disposed from said closed position of said door by at least 90°.

2. The bumper guard of claim 1 wherein said stationary support comprises a door jamb.

3. The bumper guard of claim 1 wherein said stationary support comprises a wall.

4. The bumper guard of claim 1 wherein said stationary support comprises a stationary post.

5. The bumper guard of claim 4 wherein said stationary post comprises a vertical square tube.

6. The bumper guard of claim 1 wherein said pivot means comprises a spring hinge, said spring hinge having a first and second legs extending from and pivotable about a common axis, said first leg being affixed to said stationary support and said second leg being affixed to said bumper, said spring hinge resiliently returning said bumper from its retracted position to its normal position.

7. The bumper guard of claim 1 wherein said bumper comprises a generally planar top portion, a generally planar bottom portion located below and parallel to said top portion, and a generally semicircular shaped sidewall portion extending around and between said top portion and said bottom portion.

8. The bumper guard of claim 7 wherein said sidewall portion comprises an abutting plate portion which abuts against said stationary support when said bumper is in its normal position, whereby said abutting plate portion prevents said bumper from pivoting from its normal position towards said door, said abutting plate portion having a first and a second side.

9. The bumper guard of claim 8 wherein said sidewall additionally comprises a planar sidewall portion which extends parallel to said door from a first side of said abutting plate portion, and a curvilinear sidewall portion which extends from the second side of said abutting plate portion to said planar sidewall portion.

10. The bumper guard of claim 1 additionally comprising means for preventing damage to said pivoting door as said pivoting door pivots between its normal and retracted positions whereby the pivoting door is prevented from directly engaging the bumper guard while the pivoting door is pivoted from its normal to its retracted position.

11. A bumper guard pivotable between a normal and a retracted position for use with a door which pivots inward and outward from a closed position about a pivoting door stile, comprising:

a stationary support;

a bumper, said bumper being in abutting contact with said stationary support and being located adjacent to said pivoting door stile when in its normal position;

pivot means pivotally joining said bumper to said stationary support, said pivot means allowing said bumper to pivot between its normal and its retracted positions; and a wheel rotatably affixed to and extending from said bumper in close proximity to said door, whereby said wheel will be in rolling engagement with said door when said door is pivoted towards said bumper.

12. A bumper guard pivotable between a normal and a retracted position for use with a door which pivots inward and outward from a closed position comprising:

a vertical post, said post being affixed to a stationary body;

a bumper, said bumper comprising a generally semicircular shaped sidewall portion;

a spring hinge comprising first and second legs extending from and pivotable about a common axis, said first leg being affixed to said vertical post and said second leg being affixed to said sidewall portion;

a wheel means rotatably affixed to and extending from said bumper, said wheel means coming into rolling engagement with said door when said door is pivoted toward said bumper;

said bumper capable of pivoting about the spring hinge by the outward pivoting of said door, said bumper being pivotable to a retracted position wherein said door is capable of pivoting outwards to a position disposed by at least 90° from said closed position of said door, said spring hinge resiliently pivoting said bumper to its normal position when said door is returned to its closed position, said spring hinge and said sidewall portion of said bumper preventing said bumper from pivoting from its normal position towards said door.

13. The bumper guard of claim 12 wherein said vertical post comprises:

a base plate, said base plate being affixed to a stationary body;

an interior tube, said interior tube being affixed to said base plate and extending vertically therefrom to an open end;

a spacer tube, said spacer tube concentrically surrounding said interior tube and extending vertically therefrom;

a support tube, said support tube having said second leg of said hinge affixed thereto, said support tube surrounding said interior tube and extending vertically from said spacer tube to an open end above said open end of said interior tube; and a top cap, said top cap engaging the interior of said open end of said support tube and being fastened to said stationary body to rigidly fasten said support tube to said stationary body.

14. The bumper guard of claim 13 wherein said top cap comprises:

a first plate which extends horizontally, said first plate covering said open end of said support tube;

a tube which extends downwardly from said first plate, said tube being located concentrically within and engaging the interior of said support tube; and a second plate extending vertically from one edge of said first plate, said second plate being fastened to said stationary body to rigidly fasten said top cap to said stationary body.

* * * * *